US011219280B2

(12) United States Patent
Heinemark et al.

(10) Patent No.: US 11,219,280 B2
(45) Date of Patent: Jan. 11, 2022

(54) TOOL BELT

(71) Applicant: HUSQVARNA AB, Huskvarna (SE)

(72) Inventors: Carl Heinemark, Tenhult (SE); Mikael Arvidsson, Jönköping (SE)

(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 16/763,625

(22) PCT Filed: Nov. 19, 2018

(86) PCT No.: PCT/EP2018/081792
§ 371 (c)(1),
(2) Date: May 13, 2020

(87) PCT Pub. No.: WO2019/105787
PCT Pub. Date: Jun. 6, 2019

(65) Prior Publication Data

US 2020/0281328 A1 Sep. 10, 2020

(30) Foreign Application Priority Data

Nov. 30, 2017 (SE) ..... 1751470-4

(51) Int. Cl.
*A44B 11/25* (2006.01)
*A41F 9/00* (2006.01)
(Continued)

(52) U.S. Cl.
CPC ..... *A44B 11/2519* (2013.01); *A41F 9/002* (2013.01); *A44B 11/2557* (2013.01);
(Continued)

(58) Field of Classification Search
CPC .. A41F 9/002; A45F 2200/0575; A45F 5/021; A44B 11/2519; A44B 11/2557; A44B 11/2592; A44B 11/266
See application file for complete search history.

(56) References Cited

U.S. PATENT DOCUMENTS 2,948,939 A 8/1960 Prete, Jr.
3,013,317 A 12/1961 Weber
(Continued)

FOREIGN PATENT DOCUMENTS

FR 1294259 A 5/1962

OTHER PUBLICATIONS

"Buckle Webbing Hardware," Retrieved from http://www.bucklewebbinghardware.com/.
(Continued)

*Primary Examiner* — David M Upchurch
(74) *Attorney, Agent, or Firm* — Burr & Forman, LLP

(57) ABSTRACT

A tool belt (1) comprises a belt strap (2) and a belt buckle (3), wherein the belt buckle (3) comprises a male (5) and a female part (7). The male part (5) comprises a latch plate (27) and the female part (7) comprises a female interface (9) for receiving the latch plate (27). The latch plate (27) is attached to a first end (2*a*) of the belt strap (2) and the female part (7) is attached to a second end (2*b*) of the belt strap (2), and the female part (7) comprises a locking mechanism (15) adapted for connection and disconnection of the latch plate (27) to or from the female interface (9), and a length adjustment mechanism (17) adapted for adjustment of the length of the belt strap (2).

15 Claims, 6 Drawing Sheets

(51) Int. Cl.
*A44B 11/26* (2006.01)
*A45F 5/02* (2006.01)

(52) U.S. Cl.
CPC ..... *A44B 11/2592* (2013.01); *A44B 11/266* (2013.01); *A45F 5/021* (2013.01); *A45F 2200/0575* (2013.01)

(56) References Cited

U.S. PATENT DOCUMENTS 3,396,437 A 8/1968 Burleigh
3,440,697 A * 4/1969 Proctor ..... B64D 17/32 24/637
3,673,645 A * 7/1972 Burleigh ..... A44B 11/2515 24/630
4,035,877 A * 7/1977 Brownson ..... A44B 11/263 24/323
4,150,464 A 4/1979 Tracy
4,282,634 A 8/1981 Krauss
4,425,689 A 1/1984 Fildan
4,614,010 A * 9/1986 Charlton ..... A44B 11/2511 24/635
4,876,772 A * 10/1989 Anthony ..... A44B 11/2523 24/637
4,928,364 A * 5/1990 Ikeda ..... A44B 11/2592 24/614
4,942,649 A * 7/1990 Anthony ..... A44B 11/2523 24/637
4,949,436 A * 8/1990 Anscher ..... A44B 11/263 24/616
5,237,728 A 8/1993 Fudaki
5,440,792 A * 8/1995 Ida ..... A44B 11/263 24/615
5,709,014 A * 1/1998 Takahashi ..... A44B 11/2511 24/614
5,855,057 A 1/1999 Anscher
6,647,750 B2 * 11/2003 Kaneko ..... A44B 11/263 24/606
6,694,578 B1 2/2004 Nicoll
7,073,235 B2 7/2006 Benedict
7,107,657 B1 * 9/2006 Howell ..... A44B 11/263 24/614
7,343,651 B2 * 3/2008 Niwa ..... A44B 11/263 24/616
7,874,049 B2 * 1/2011 Paik, II ..... A44B 11/263 24/615
7,904,997 B2 * 3/2011 Foubert ..... A44B 11/2526 24/631
8,261,417 B2 * 9/2012 Yoshiguchi ..... A44B 11/2592 24/633
8,978,214 B2 3/2015 Kataoka et al.
9,113,678 B2 8/2015 Leung
2006/0053600 A1 3/2006 Liu
2012/0073096 A1 3/2012 Lai

OTHER PUBLICATIONS

Swedish Search Report for Application No. 1751470-4 dated May 25, 2018.
International Search Report and Written Opinion for International Application No. PCT/EP2018/081792 dated Jan. 25, 2019.
International Preliminary Report on Patentability for International Application No. PCT/EP2018/081792 dated Jun. 2, 2020.

* cited by examiner

Fig. 4
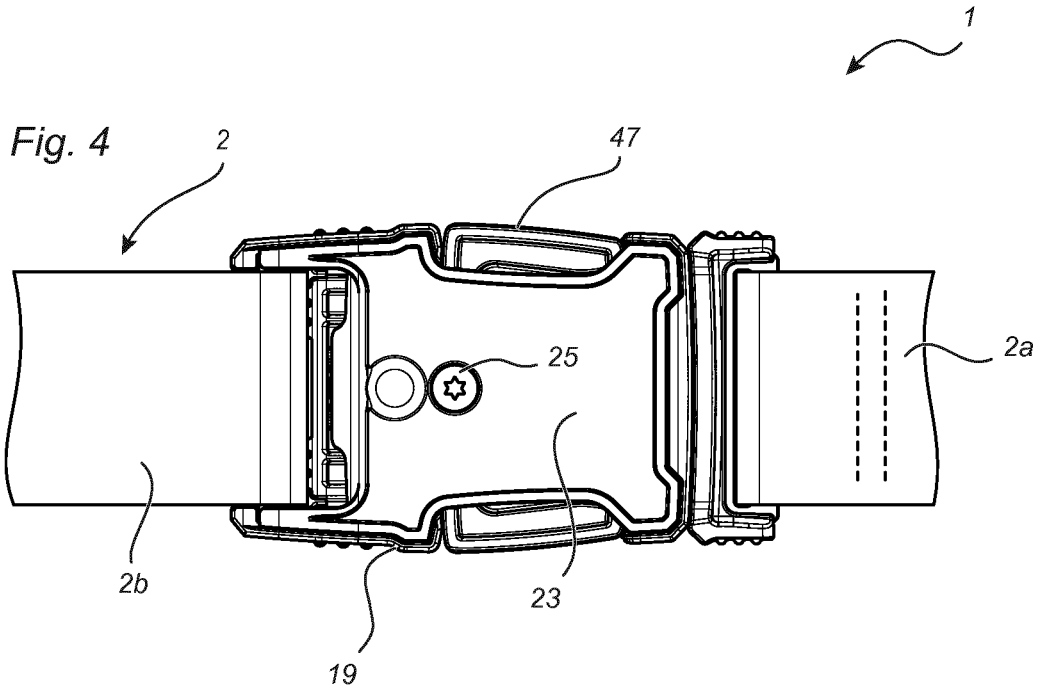
Fig. 5A
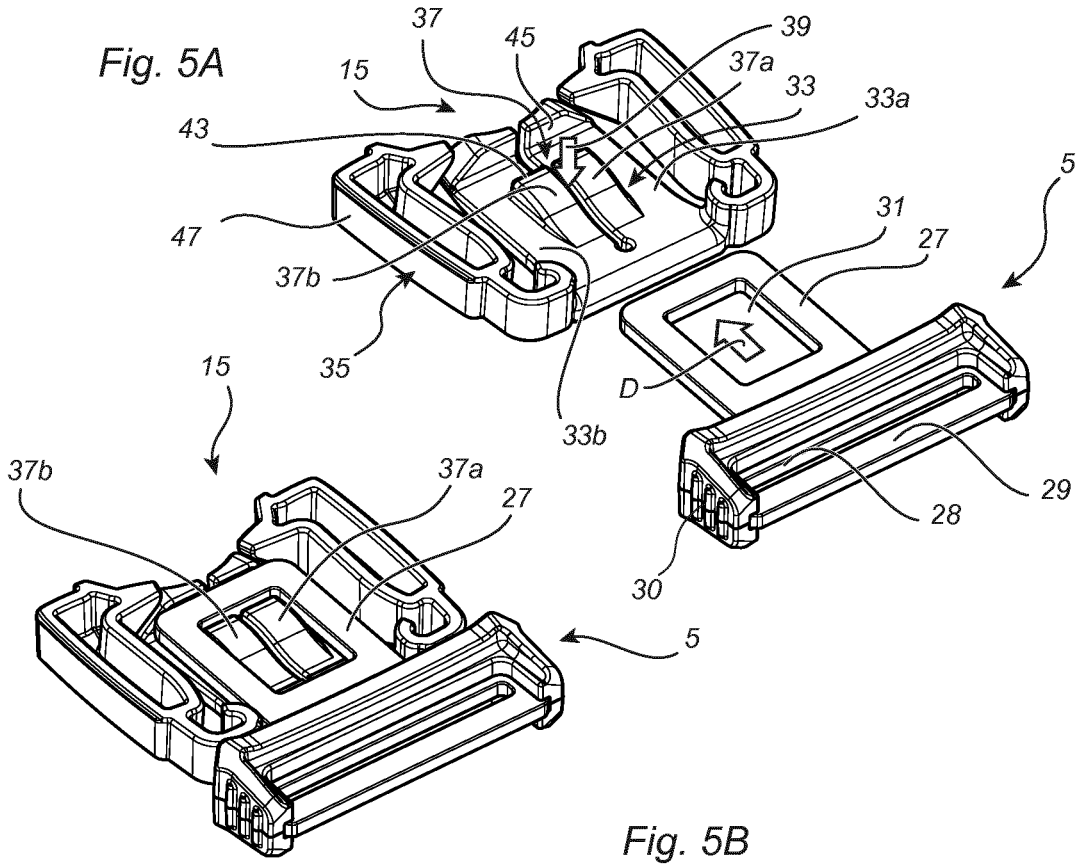
Fig. 5B

TOOL BELT

FIELD OF THE INVENTION

The present invention relates to a tool belt, especially to a tool belt comprising a belt strap and a belt buckle.

BACKGROUND OF THE INVENTION

Craftsmen and forest workers often use waist tool belts, or a tool belt in the form of a harness, or a combination of both to carry their tools in during work for easy access and to prevent from dropping the tools. These kinds of tool belts may be equipped with a belt buckle, in which a device attached to one end of the belt strap is fitted or coupled to the other end of the belt strap in front of the user.

A belt buckle is to hold the belt tight around the user, and makes sure that the buckle parts will not separate so that the tool belt becomes loose, by using a reliable locking mechanism to secure the buckle parts.

In case of emergency, it is important that the belt buckle is openable in a quick and easy manner without risk of failure especially since craftsmen and forest workers wear protective gloves on their hands. Therefore, belt buckles for tool belt are often designed with large interface features, for example button, levers, pins etc, which causes the buckle's design to be perceived as inconvenient to the user and prevents the user from moving freely.

It is also desirable to have a function for adjusting the belt length quickly and easily. This may be useful both for tightening of the belt and when the user temporary wants to loosen the belt during breaks, when walking to the work site and when sitting down. This function must also be possible to manoeuvre when wearing gloves.

SUMMARY

An object is therefore to obtain a tool belt comprising a belt buckle with a smooth design, that is not preventing the user from moving freely and that is easy for the user to manoeuvre when wearing gloves.

This object is at least partly achieved by means of a tool belt comprising a belt strap and a belt buckle, wherein the belt buckle comprises a male and a female part. The male part comprises a latch plate and the female part comprises a female interface for receiving the latch plate. The male part may be attached to a first end of the belt strap and the female part may be attached to a second end of the belt strap. The female part may comprise a locking mechanism adapted for connection and disconnection of the latch plate to or from the female interface, and a length adjustment mechanism adapted for adjustment of the length of the belt strap.

By arranging both the locking mechanism and the length adjustment mechanism within the female part, a smooth design of the belt buckle may be achieved, which may easily be operated by the user.

The female interface may be disposed at one end of the female part and the length adjustment mechanism may be disposed at the opposite end of the female part. Optionally, the locking mechanism may be disposed at the female interface end.

This makes it easier for the user to distinguish the two mechanisms, especially when wearing gloves. By placing the different mechanisms on the opposite ends of the female part, there is a better room for the parts of the respective mechanisms, without the two mechanisms affecting each other, and hence a slimmer design of the buckle can be achieved.

The locking mechanism may be a snap lock comprising a latch locking portion arranged inside the female part, wherein the latch locking portion may comprise a connection ramp, and wherein the latch plate may be configured to be connected to the female interface when the latch plate is moved over the connection ramp, thereby pressing the connection ramp in a latch release direction transversal to an axis of insertion of the latch plate into the female interface and the connection ramp snaps back into a latch locking direction opposite to the latch release direction.

Hereby is provided a simple locking mechanism with few parts that interact with each other and do not require much space, which contributes to a smooth and compact design of the belt buckle. It may also provide a simple mechanism that easily can be manoeuvred by the user when wearing gloves. The latch release direction may be substantially perpendicular to said axis of insertion.

The latch plate may comprise an opening, wherein the opening may be adapted to engage with the connection ramp of the latch locking portion. Optionally the opening may engage against a locking edge of the connection ramp.

Hereby, the design of the latch plate corresponds with the design of the connection ramp, which gives a simple solution with few parts and takes little space in a limited area within the belt buckle.

The latch locking portion may be divided in two individually movable parts, wherein each movable part may be configured to be actuated by a respective latch release actuator.

This contributes to a safety aspect since the user must actuate the two latch release actuators at the same time to release the tool belt from the belt buckle, and minimizes the risk for unintentional release that could occur if one of the belt release actuators is pressed by accident.

The female part may further comprise a latch release mechanism, wherein the latch release mechanism may comprise two latch release actuators, configured to release the latch plate from the female interface, wherein the latch release actuators may extend outwardly through respective openings in opposite sidewalls of the female part.

Since the two latch release actuators are extending outwardly through openings in opposite sidewalls of the female part, these parts take less place inside the female part, contributing to a compact design of the buckle. The latch release actuators can also easily by recognized and accessed by the user, even when the user is wearing gloves.

The latch release portion may be resilient and integrally formed of one single piece of material together with the latch locking portion.

Hereby is created a simple design with few parts that requires little space, is cheap to manufacture, is easy to replace when broken or worn out, and has high reliability.

Each of the two latch release actuators and/or the latch locking portion may comprise a respective release ramp, wherein the latch plate may be configured to be disconnected from the female interface when the two latch release actuators are pressed simultaneously towards each other, the release ramps thereby pressing the latch locking portion in the latch release direction transverse the axis of insertion of the latch plate into the female interface.

The user will be able to disconnect the belt strap from the belt buckle with a simple manoeuvre, which can be performed when wearing gloves. The release mechanism is made up of a few simple parts that require little space, but has high reliability.

The latch plate may be fixedly connected to the first end of the belt strap.

The second end of the belt strap may form a loop around a rod in the female part, which rod may be disposed at the opposite end in relation to the female interface and arranged perpendicular to an axis of insertion of the latch plate into the female part, wherein a belt release actuator may be arranged for step-less adjustment of the second end of the belt strap.

The tool belt may thus be led straight in and out from one side of the belt buckle and not from behind, which is more common, which contributes to a slimmer design since the belt buckle will be able to lie closer to the user's body.

The belt release actuator may be movable between two positions: a belt locking position, where the belt release actuator presses the second end of the belt strap against the rod and a belt release position, where the second end of the belt strap runs freely around the rod.

Hereby is created a quick and easy mechanism for adjustment of the belt length that is easy to manoeuvre when the user is wearing gloves.

The belt release actuator may be resiliently biased towards the belt locking position.

This allows the user to adjust the length of the belt strap in a step-less manner to the desired tension.

The belt release actuator may be configured to be pressed against bias in a belt release direction transversal to a direction in which latch release actuators are configured to be pressed for disconnection of the latch plate from the female interface.

This further contributes to the safety aspect, since the belt adjustment mechanism and the belt locking mechanism are actuated by pressing different parts in different directions. Thereby, it will become easier for the user to separate them from each other, especially when wearing gloves. The belt release direction may also be transversal, or substantially perpendicular to the axis of insertion of the latch plate into the female interface.

The belt release actuator may be provided with tooth shaped protrusions, configured to engage with the second end of the belt strap when in the belt locking position.

This provides a large area and several contact points between the belt release actuator and the belt strap, that keeps the belt strap in place.

The belt release actuator may be pivotal between said two positions about an axis substantially parallel to the rod, wherein the belt release actuator may be configured to, when in the belt locking position, squeeze the belt strap against the rod in a self-locking manner when the first end of the belt strap is pulled in a direction away from the female part.

This self-locking of the belt strap may keep the tool belt in place when exposed to load, for example the weight of the tools that are connected to the tool belt.

The female part may comprise a housing enclosing the locking mechanism and the length adjustment mechanism, and a cover, covering both the locking mechanism and the length adjustment mechanism.

This creates a robust and smooth design of the belt buckle, where all vital parts of the locking mechanism and the length adjustment mechanism are covered by the housing and fixed in place by the cover.

BRIEF DESCRIPTION OF THE DRAWINGS

The above, as well as additional objects, features, and advantages of the present invention, will be better understood through the following illustrative and non-limiting detailed description of preferred embodiments of the present invention, with reference to the appended drawings, where the same reference numerals will be used for similar elements, wherein:

FIG. 4 shows a rear view of the tool belt and the belt buckle.

FIGS. 5A-5B show perspective views of a locking mechanism of the belt buckle when a latch plate is connected to a female interface.

DETAILED DESCRIPTION OF THE EXEMPLARY EMBODIMENTS

Figure 1:
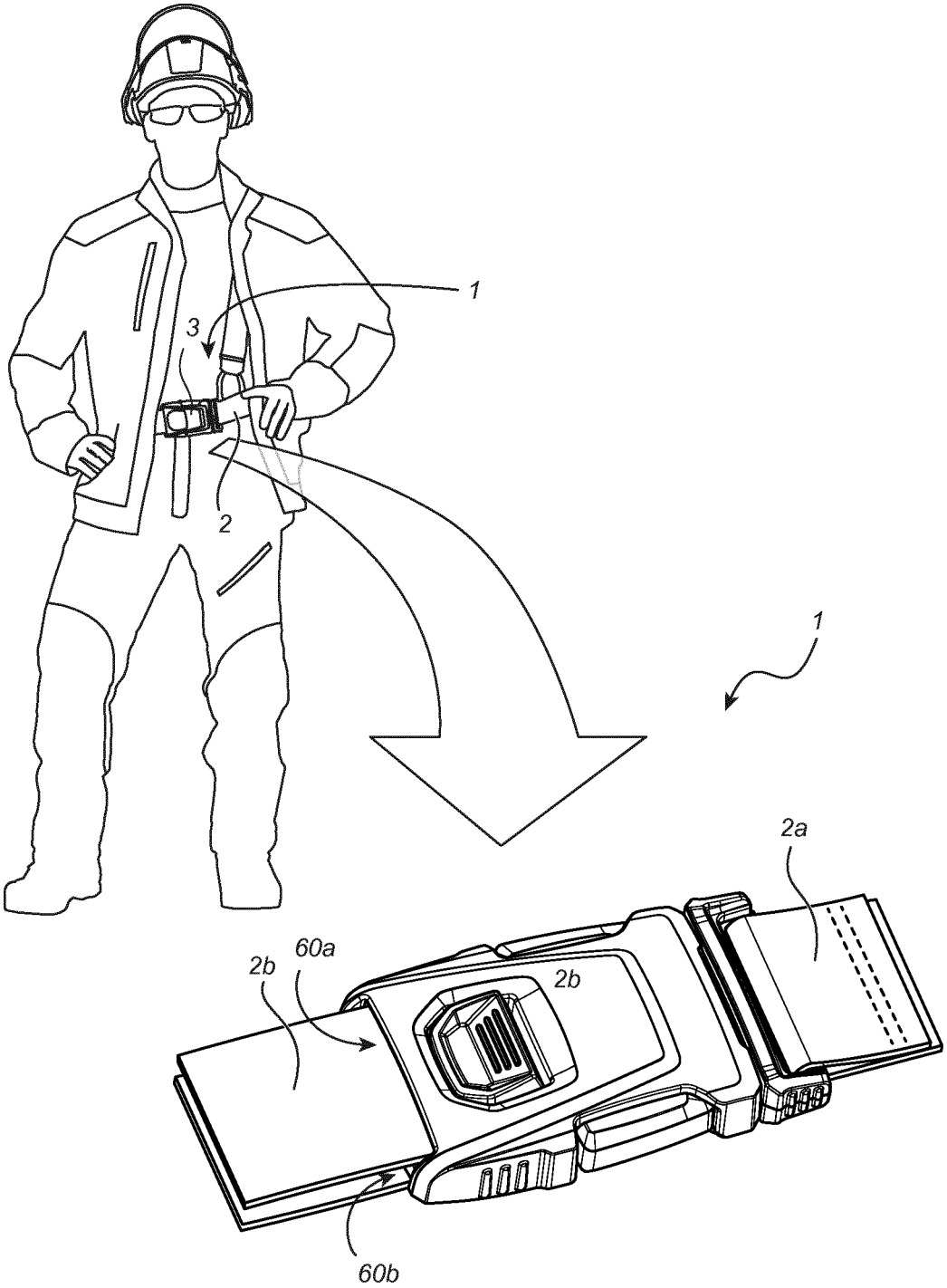
FIG. 1 shows a forest worker with a tool belt attached around the waist.

Forest workers and craftsmen often have their tools attached to a waist tool belt or a harness since they make use of a lot of tools during their ordinary work. A tool belt 1 can be seen in FIG. 1.

Figure 2A:
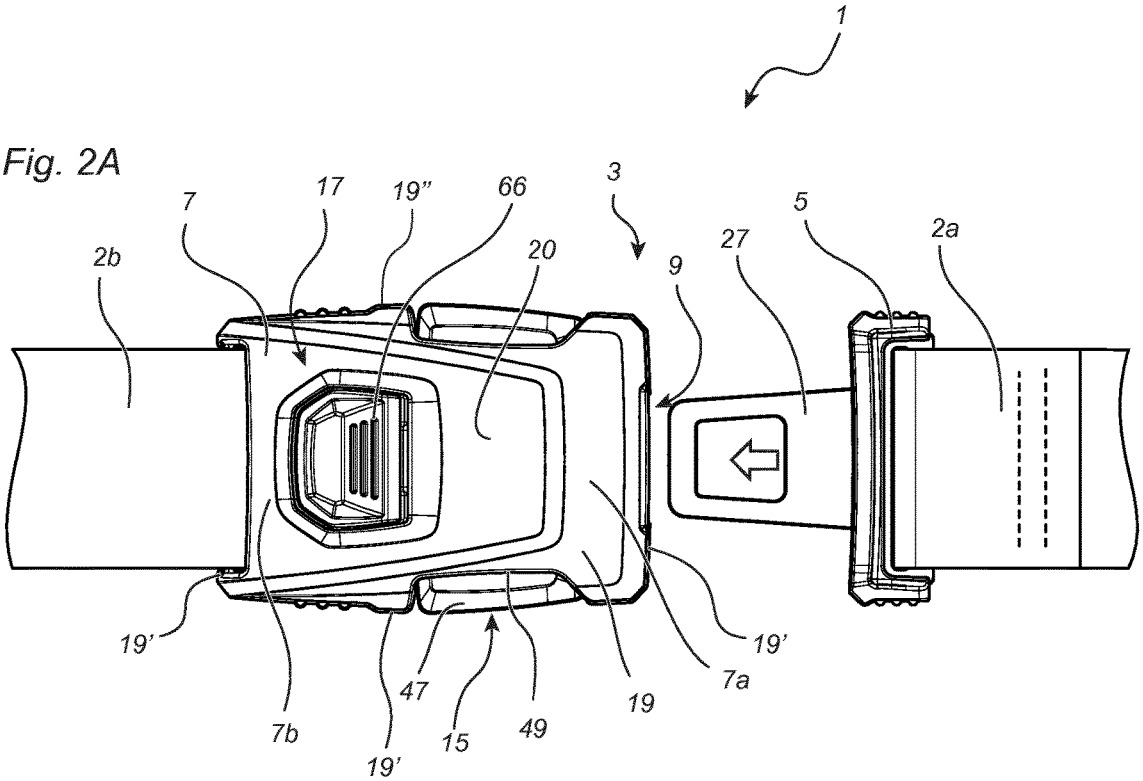
FIG. 2A shows a front view of the tool belt and the belt buckle in a disconnected position.
Figure 2B:
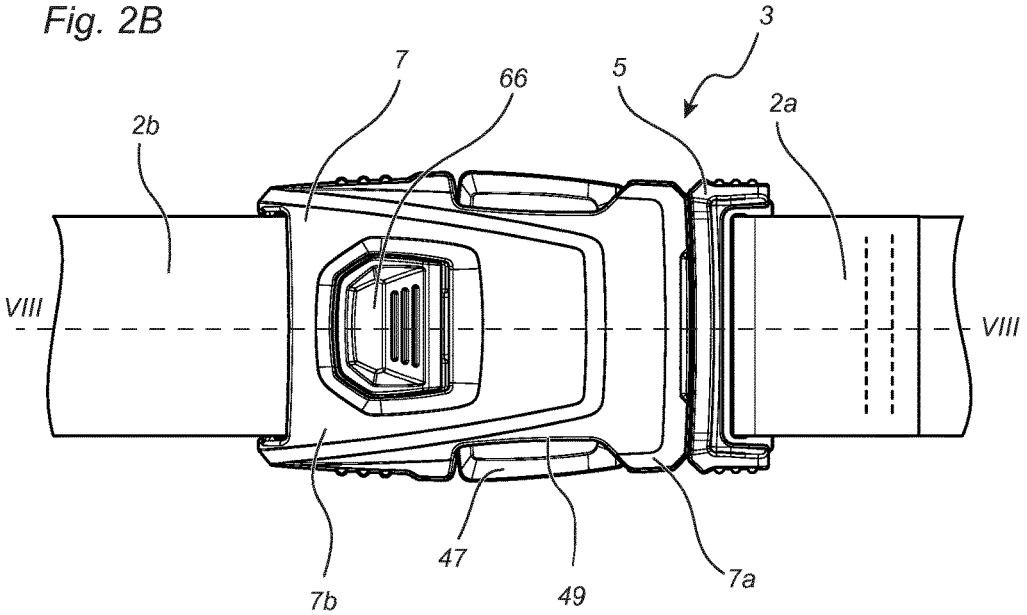
FIG. 2B shows a front view of the tool belt and the belt buckle in a connected position.

FIGS. 2A-B and 4 shows a tool belt 1 comprising a belt strap 2 and a belt buckle 3 according to one embodiment. The belt buckle 3 comprises a male part 5, provided with a latch plate 27, and a female part 7 with a female interface 9 for receiving the latch plate 27. The male part 5 is attached to a first end 2*a* of the belt strap 2 and the female part 7 is attached to a second end 2*b* of the belt strap 2. The female part 7 may comprise a locking mechanism 15 for connection and disconnection of the latch plate 27 to or from the female interface 9, arranged at a first longitudinal end 7*a* of the female part 7, and a length adjustment mechanism 17 (cf FIGS. 8*a*, 8*b*) for adjustment of the length of the tool belt 1, arranged at a second longitudinal end 7*b* of the female part 7.

The female part 7 comprises a housing 19, with two long sides 19', two short sides 19", and a top face 20, to accommodate all parts of the locking mechanism 15 and the length adjustment mechanism 17. The housing 19 may be integrally formed. By way of example, it may be moulded as a single piece of plastic, but it may also be made of a single piece of metal. Plastic material gives a lighter belt buckle 3 with higher comfort for the user since the belt buckle 3 lies tightly against the user's body, while metal gives a more robust belt buckle 3 that could resist rough handling. The female interface 9 may be a recess or a slot in one of the short sides 19" of the female part 7 for receiving the latch plate 27.

Figure 3A:
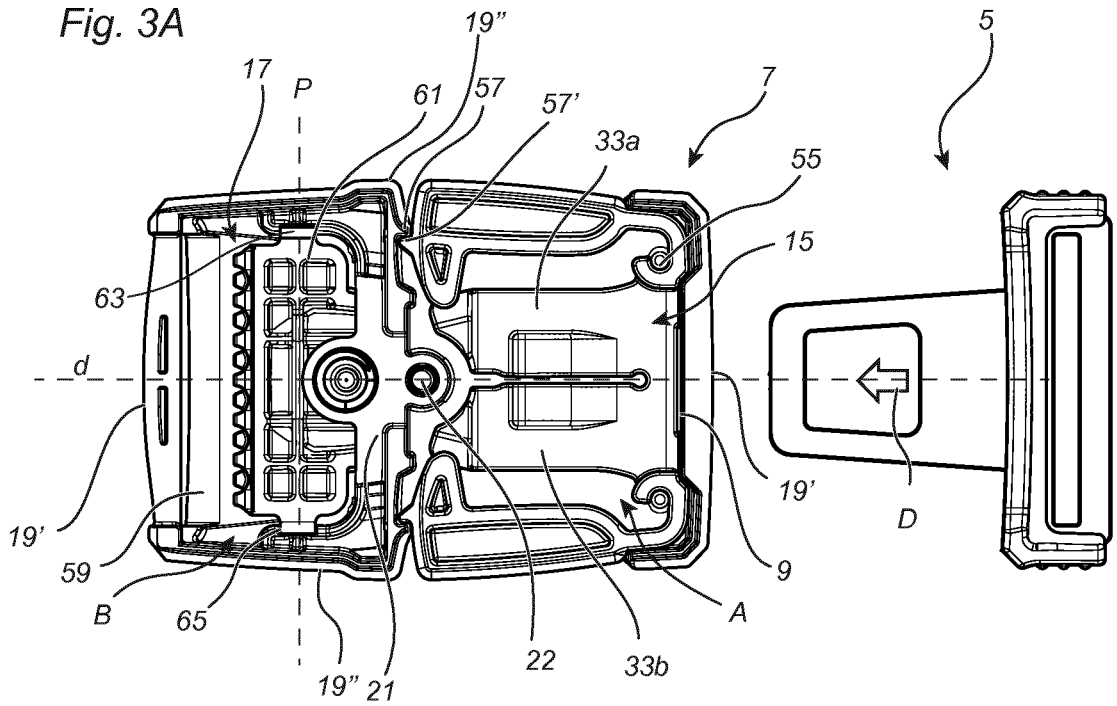
FIG. 3A shows a front view in section of the belt buckle in the disconnected position, with interior parts exposed.
Figure 3B:
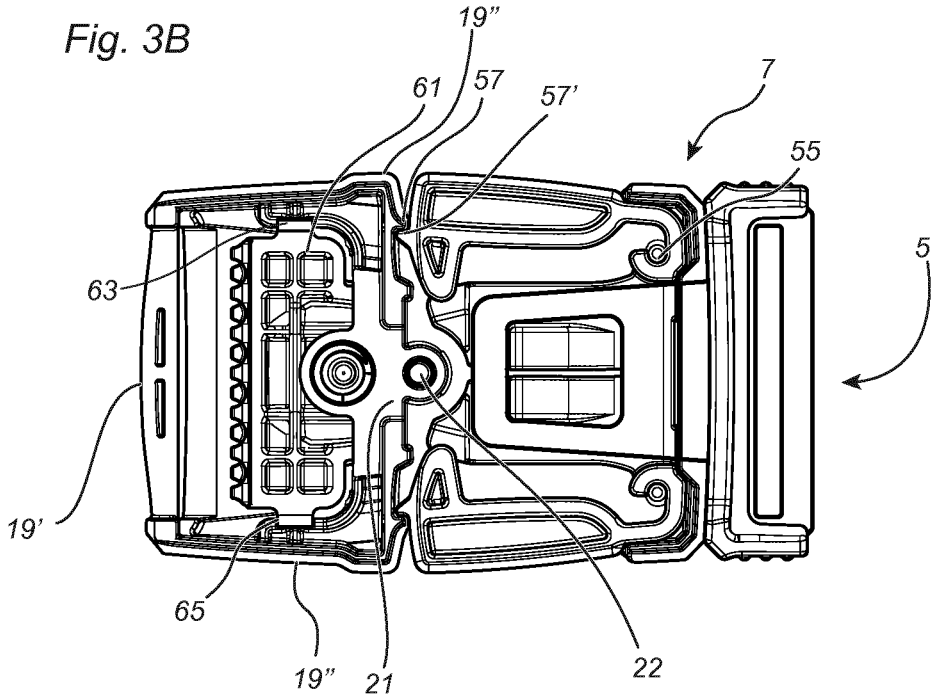
FIG. 3B shows a front view in section of the belt buckle in the connected position, with interior parts exposed.

Now with reference to FIGS. 3A-B, the housing 19 defines a first space A, that accommodates the locking mechanism 15 and a second space B, that accommodates the belt length adjustment mechanism 17. The spaces, A, B may be separated by a partition 21, so that the different mechanisms 15, 17 do not affect each other.

As seen in FIG. 4, the female part 7 may further comprise a cover 23, which holds all vital parts of the locking mechanism 15 and the length adjustment mechanism 17 (FIG. 3A) in place inside the housing 19 and protect these parts. The cover 23 may have a shape that corresponds with the shape of the housing 19, with two long sides and two short sides. The cover 23 may be attached to the housing 19 by a fastening device, for example a screw 25, that easily can be removed to replace or repair the locking mechanism 15 and/or the length adjustment mechanism 17. The screw 25 may be fastened in a thread 22, arranged inside the housing 19 (cf FIG. 3A).

FIGS. 5A and 5B show the male part 5 and the locking mechanism 15 and how the latch plate 27 may be connected to the female interface 9 (FIG. 2A) by using the locking mechanism 15.

The male part 5 may comprise a latch plate 27, made as one piece of sheet metal for safety reasons, to sustain forces created by the tools attached to the tool belt 1 and/or forces applied by the user's body on the tool belt 1. The male part 5 may further comprise a gripping portion 29, for attachment of the first end 2*a* of the belt strap 2 to the male part 5. The gripping portion 29 may have an opening 28 and the first end 2*a* of the belt strap 2 may be fixed connected to the male part 5 by folding the first end 2*a* of the belt strap 2 through the opening 28 and around the gripping portion 29 and then fixation of the first end 2*a* of the belt strap 2 to another part of the belt strap 2, for example by sewing. The gripping portion 29 may comprise a layer of a plastic material to facilitate grasping of the male part 5 during connection and disconnection of the latch plate 27 to or from the female interface 9. The outer edges of the gripping portion 29 may be provided with ribs 30 to facilitate handling of the male part 5 when the user is wearing gloves.

The locking mechanism 15 may comprise two portions, a latch locking portion 33, for connection of the latch plate 27 to the female interface 9 and a latch release portion 35, for disconnection of the latch plate 27 from the female interface 9. These two portions 33, 35 may be resilient and integrally formed from one piece of a material, for example, a plastic material or a metal. The locking mechanism 15 may be accommodated inside the first space A of the housing 19 (cf FIG. 3A).

The latch locking portion 33 may comprise a connection ramp 37. In the example shown in FIGS. 5A and 5B, the connection ramp 37 consists of two individually, movable parts (37*a*, 37*b*). The latch plate 27 may comprise an opening 31, whose shape corresponds to the shape of the connection ramp 37. When the latch plate 27 is moved over the connection ramp 37, the latch plate 27 presses the connection ramp 37 in a latch release direction 39, transversal to an insertion direction D along an axis of insertion d (FIG. 3A) of the latch plate 5 into the female interface 9. When the front part of the latch plate 27 has passed the connection ramp 37, the connection ramp 37 snaps back in a latch locking direction opposite to the latch release direction 39, into the opening 31. Due to the resilient material of the latch locking portion 33, the locking mechanism 15 operates as a snap-lock. When the latch plate 27 has locked to the female interface, the connection ramp 37 is fitted into the opening 31 of the latch plate 27, as seen in FIG. 5B. The latch plate 27 is held in place through abutment to a front edge 43 of the connection ramp 37, and an insertion stop formed by a front part 45 of the latch locking portion 33 defines a stop position in the insertion direction. Since the connection ramp 37 consists of two individually movable parts 37*a*, 37*b*, the latch plate 27 connects to the female interface 9 by pressing these two parts 37*a*, 37*b* in the release direction 39 simultaneously.

Figure 6A:
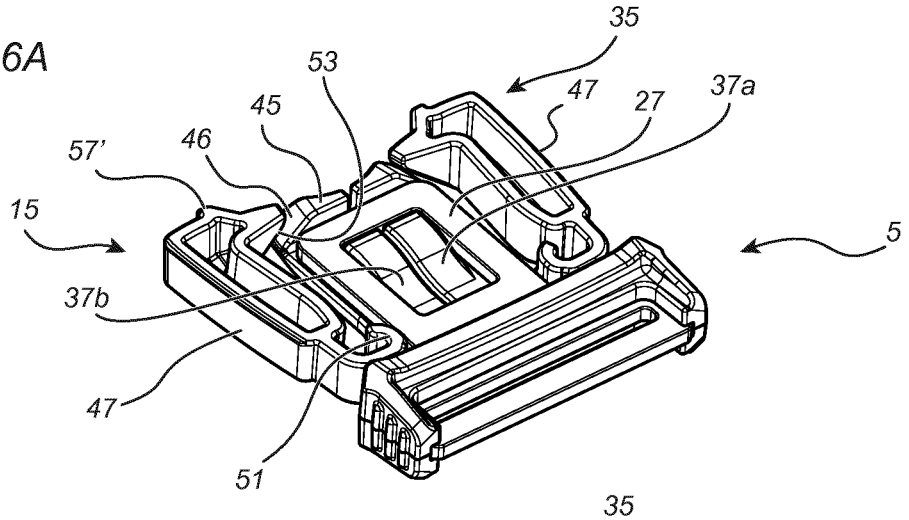
FIGS. 6A-6C show perspective views of the locking mechanism when the latch plate is disconnected from the female interface.
Figure 6B:
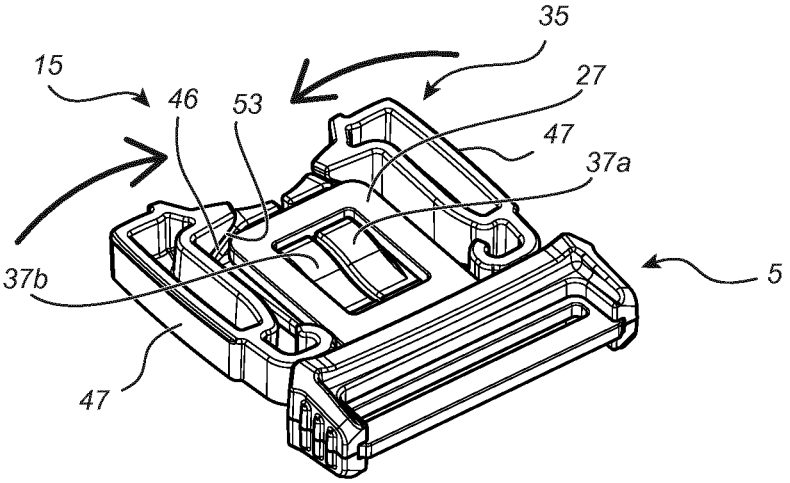
Figure 6C:
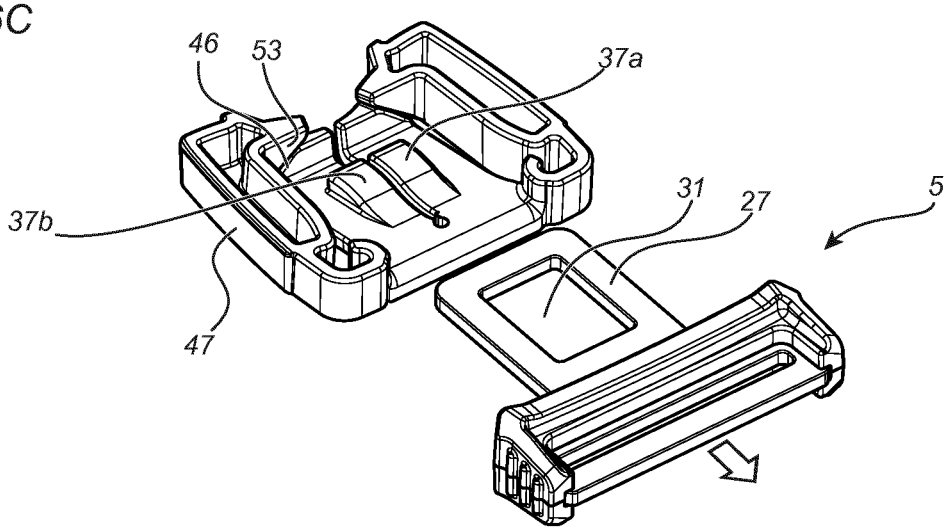

FIGS. 6A-6C shows the male part 5 and the locking mechanism 15, and how the latch plate 27 may be disconnected from the female interface 9 by using the latch release portion 35 of the locking mechanism 15. FIG. 6A illustrates the latch plate 27 connected to female interface 9 and the latch release actuators 47 being unpressed. FIG. 6B illustrates the motion of the latch release actuators 47 being slightly pressed. FIG. 6C illustrates latch release actuators 47 fully pressed and the latch plate 5 having been disconnected from the female interface 9.

The latch release portion 35 may comprise two latch release actuators 47. In the shown embodiment, these latch release actuators 47 are configured as side arms and extend outwardly through openings 49 (FIG. 2A) in opposite long sides 19' of housing 19, when the locking mechanism 15 is positioned within the housing 19.

Each of the latch release actuators 47 may be attached to a respective part 33*a*, 33*b* of the latch locking portion 33 through a respective resilient loop 51, arranged at one end of the latch release actuator 47, which loop 51 biases the respective latch release actuator 47 outwards through the respective opening 49. On the opposite end of each latch release actuator 47, a release ramp 53 may be arranged. The release ramp 53 faces the front part 45 of the latch locking portion 33. In the shown embodiment, each respective latch locking portion 33*a*, 33*b* and the latch release actuator 47 comprises a respective release ramp 46, 53 but other embodiments are possible, for example either only the latch locking portions 33*a*, 33*b* or only the latch release actuators 47 may comprise respective release ramps 46, 53.

To keep the locking mechanism 15 in place inside the housing 19, the housing 19 may have bars 55 extending from the inside of the housing 19 (cf FIG. 3A), around which bars 55, the loops 51 of the latch release actuators 47 can be attached; the bars 55 also define pivots about which the release actuators 47 may turn when pressed. The long sides 19" of the housing 19 may comprise edges 57 (cf FIG. 3A) that abut corresponding edges 57' on the latch release actuators 47 to further secure the locking mechanism 15 inside the housing 19 and provide an outer end stop position of the latch release actuators 47.

When the latch plate 27 is connected to the female interface 9, the release ramps 53 of the latch release actuators 47 may face the corresponding release ramps 46 on the latch locking portion 33, as seen in FIG. 6*a*.

When the latch plate 27 is to be released from the female interface 9, the latch release actuators 47 may be pressed simultaneously towards each other, in a direction transversal or substantially perpendicular to the insertion axis d (FIG. 3A) and the latch release direction 39 (FIG. 5A). The release ramps 53 of the latch release actuators 47 are pressed against the release ramps 46 on the locking portion 33, and the locking portion 33 is thereby pressed in the latch release direction 39, transverse to the axis of insertion d of the latch plate 27 into the female interface 9, as seen in FIG. 6B. The cover 23 supports the locking mechanism 15 during this action.

When the latch release actuators 47 are fully pressed towards each other, both parts 37*a*, 37*b* of the connection ramp 37 on the latch locking portion 33 are pushed away from the opening 31 in the latch plate 27, and the latch plate 27 is disconnected from the female interface 9, as seen in FIG. 6C, and can be removed from the female part 7, and the tool belt 1 can be removed from the user.

Having latch release actuators 47 on the side of the belt buckle 3, rather than on the front of the buckle 3, minimizes the risk of unintentional release that could otherwise occur if the user is bumping into protruding obstacles. The long sides 19" of the housing 19, on both sides of the openings 49, are substantially flush with an outer edge of the latch release actuators 47, and thereby prevent the latch release actuators 47 from being to be exposed to pressure from the sides of the belt buckle 3.

As a further safety, the latch locking portion 33 is divided in two individually movable parts, and the latch release actuators 47 are arranged to operate on a respective part of the latch locking portion 33. Thereby, the latch plate 27 can't be disconnected from the female interface 9 if only one of the two latch release actuators 47 are pressed. The latch release actuators 47 are designed with simple interfaces and can easily by manoeuvred by a user wearing gloves.

The locking mechanism 15 with the latch locking portion 33 and the latch release portion 35 formed as an integral part with flexible/resilient geometry gives a simple solution with few parts and takes little space in a limited area within the belt buckle 3. The locking mechanism 15 is cheap to manufacture and easy to replace.

Referring to FIG. 3A, the length adjustment mechanism 17 may be accommodated at the second space B of the housing 19, opposite in relation to the female interface 9. The second end 2*b* (FIG. 2A) of the belt strap 2 passes straight in from one of the short sides 19" of the housing 19, forms a loop around a rod 59 (cf FIG. 3A) and passes out from the housing 19 in the same direction. In the shown embodiment, the rod 59 is integrally formed with the housing 19, and defines a pair of belt guide slots 60*a*, 60*b* (FIG. 1) in one of the short sides 19". It would also be possible to use a separate rod 59 that is placed within and connected to the inside of the housing 19. The rod 59 may be arranged perpendicular to the axis of insertion d of the latch plate 27 into the female interface 9, and thus along the short side 19" of the housing 19.

The belt strap 2 is thus led straight into and out from one short side 19' of the belt buckle 3, substantially parallel to the axis of insertion d, and not from behind, which is more common. This contributes to a slimmer design since the belt buckle 3 will be able to lie closer to the user's body.

Figure 7:
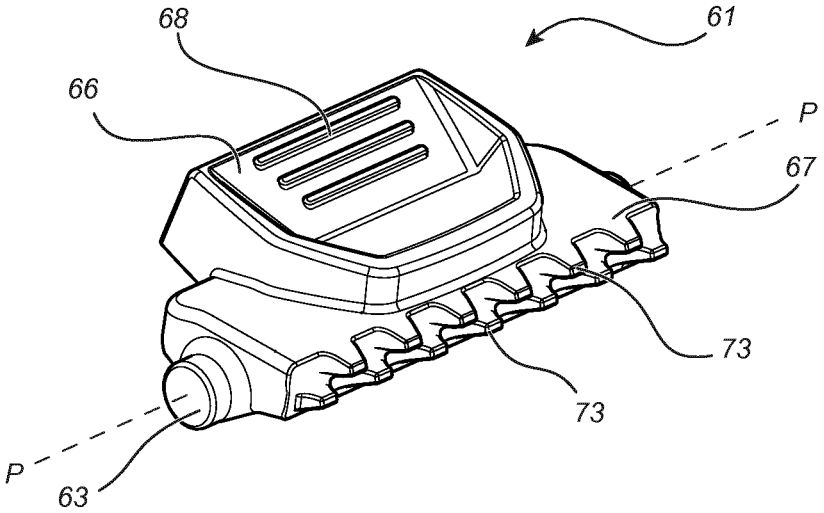
FIG. 7 shows a belt release actuator in perspective.

The length adjustment mechanism 17 may comprise a belt release actuator 61, arranged for step-less adjustment of the second end 2*b* of the belt strap 2. A belt release actuator 61 comprising a belt strap engagement portion 67 can be seen in FIG. 7. The belt release actuator 61 may be provided with pivot pins 63, that fit into corresponding recesses 65, arranged on the inside of the housing 19 (cf FIG. 3A). The belt release actuator 61 may thereby be pivotally suspended in the housing 19 to pivot about the pins 63, about a pivot axis P parallel to the rod 59. When the belt release actuator 61 is connected to the inside of the housing 19, the belt release actuator 61 extends across the housing 19, parallel to the short side 19" (cf FIG. 3A).

The belt release actuator 61 may further comprise an operator interface 66, which may be configured as a button, and the housing 19 may be provided with an opening that corresponds to the shape of the operator interface 66. When the belt release actuator 61 is connected to the inside of the housing 19, the operator interface 66 can be reached by the user from the front side of the belt buckle 3 (cf FIG. 2A). The belt release actuator 61 is designed with a simple interface, which makes it easy for a user to find and manoeuvre when wearing gloves. The operator interface 66 may be provided with ribs 68 to further facilitate the operation of the belt release actuator 61 when the user is wearing gloves.

Figure 8A:
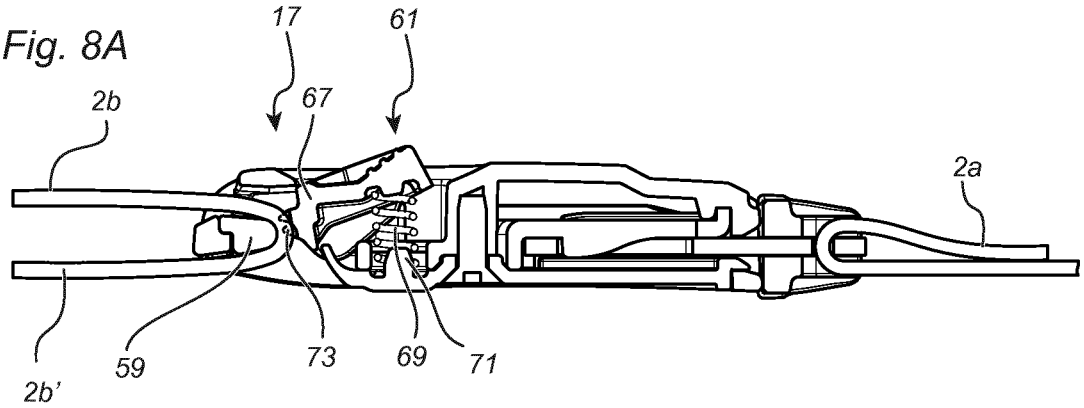
FIG. 8*a* shows a section view of the belt adjustment mechanism in a locked position, wherein the section is taken along the line VIII-VIII of FIG. 2B.
Figure 8B:
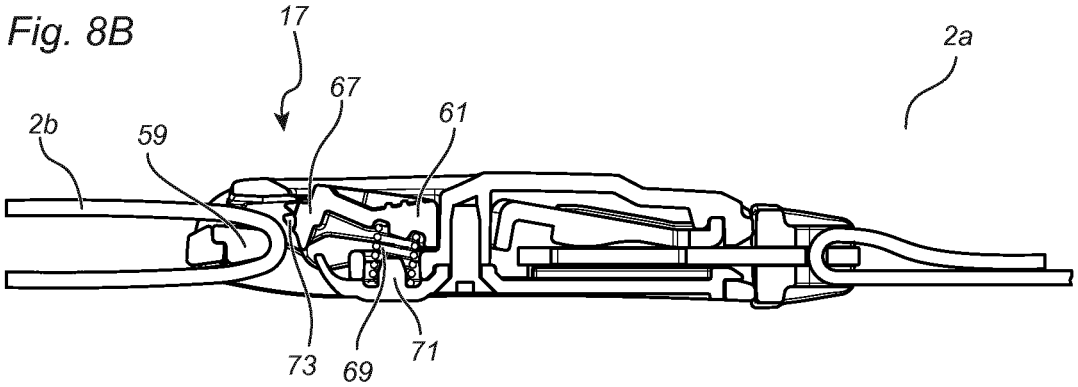
FIG. 8*b* shows a section view of the belt adjustment mechanism in an opened position, wherein the section is taken along the line VIII-VIII of FIG. 2B.

FIGS. 8A and 8A illustrate the belt buckle 3 in a section taken along a plane defined by the latch release direction 39 and the axis of insertion d of the latch plate into the female interface 9, as illustrated by the line VIII-VIII of FIG. 2B. As seen in FIGS. 8A and 8B, the belt release actuator 61 may pivot between two positions: a belt locking position (FIG. 8A), where the belt release actuator 61 presses the second end 2*b* of the belt strap 2 against the rod 59, and a belt release position (FIG. 8B), where the second end 2*b* of the belt strap 2 runs freely around the rod 59.

The belt release actuator 61 may be resiliently biased towards the locking position. This allows the user to pull the free end portion of the second end 2*b* of the belt strap 2 to the desired tension/length, where after the belt strap 2 is held in place by the belt engagement portion 67 biased against the belt strap 2. In the shown embodiment of FIGS. 8A and 8B, a coil spring 69 creates the biased action, acting on the belt release actuator 61. The coil spring 69 is positioned in a holder 71 formed in the partition 21 (FIG. 3A) of the housing 19 and is held in place by the cover 23 (FIG. 4). Instead of a coil spring 69 to create the biased action, other resilient elements may be used. In the shown embodiment, a coil spring 69 is used due to its simple shape, that can easily be fitted inside a limited space such as the inside of the belt buckle 3.

The belt engagement portion 67 may be provided with a belt engagement surface, which abuts the second end 2*b* of the belt strap 2 in the belt locking position. This belt engagement surface made be provided with tooth shaped protrusions 73. These tooth shaped protrusions 73 penetrate and engage with the belt strap 2 and keeps the tool belt 1 tensioned when exposed to load, for example while the forest worker or craftsman is working. The tooth shaped protrusions 73 may be placed in one, two, or more rows. In the shown embodiment, the teeth 73 are placed in two rows, where the teeth form a zig, zag pattern. This provides a large area and several contact points between the belt release actuator 61 and the belt strap 2, that keeps the belt strap 2 in place.

FIG. 8A shows a section view of the belt release actuator 61 in the belt locking position, where the coil spring 69 urges the tooth shaped protrusions 73 to engage with the second end 2*b* of the belt strap 2, and thereby urges the belt release actuator 61 towards a position where it extends from the front side of the belt buckle 3 (cf FIG. 1), which makes it easier for a user to find the belt release actuator 61 when needed. Pulling the second end 2*b* of the bels strap 2 pivots the belt release actuator 61 in a release direction, whereas pulling the portion 2*b*' of the belt strap 2 closest to the body of the user pivots the belt release actuator 61 in the belt locking direction, bringing the teeth 73 into stronger engagement with the belt strap 2.

FIG. 8B shows a section view of the belt release actuator 61 in the belt release position. By pressing the operator interface 66 of the belt release actuator 61, the belt release actuator 61 pivots to move the teeth 73 away from the second end 2*b* of the belt strap 2, and it is possible to adjust the tension/length of the tool belt 1 to a desired position without dropping the tool belt 1.

The operator interface 66 of the belt release actuator 61 may configured to be pressed against the bias in a direction transversal to the direction of which the latch release actuators 47 are pressed for disconnection of the latch plate 27 from the female interface 9. Since the two mechanisms operate in different directions, it is easier for a user wearing gloves to separate the two mechanisms from each other.

The invention has mainly been described above with reference to a few embodiments. However, as is readily appreciated by a person skilled in the art, other embodiments than the ones disclosed above are equally possible within the scope of the invention, as defined by the appended patent claims. By way of example, the belt release actuator 61 has been illustrated to pivot about a pivot axis. This is not necessary. The length adjustment mechanism may operate in a completely different manner, and may comprise, for example, a belt release actuator configured to translate without pivoting.

The invention claimed is:

1. A tool belt comprising a belt strap and a belt buckle, wherein the belt buckle comprises a male and a female part, the male part comprising a latch plate and the female part comprising a female interface for receiving the latch plate, wherein the male part is attached to a first end of the belt strap and the female part is attached to a second end of the belt strap, wherein the female part comprises a locking mechanism adapted for connection and disconnection of the latch plate to or from the female interface, and a length adjustment mechanism adapted for adjustment of the length of the belt strap;

wherein the female part further comprises a latch release mechanism, wherein the latch release mechanism comprises two latch release actuators, configured to release the latch plate from the female interface, wherein the latch release actuators extend outwardly through respective openings in opposite sidewalls of the female part.

2. The tool belt according to claim 1, wherein the female interface is disposed at one end of the female part and the length adjustment mechanism is disposed at the opposite end of the female part.

3. The tool belt according to claim 1, wherein the locking mechanism is a snap lock comprising a latch locking portion arranged inside the female part, wherein the latch locking portion comprises a connection ramp; and wherein the latch plate is configured to be connected to the female interface when the latch plate is moved over the connection ramp, thereby pressing the connection ramp in a latch release direction transversal to an axis of insertion of the latch plate into the female interface and the connection ramp snaps back into a latch locking direction opposite to the latch release direction.

4. The tool belt according to claim 3, wherein the latch plate comprises an opening, wherein the opening is adapted to engage with the connection ramp of the latch locking portion.

5. The tool belt according to claim 3, wherein the latch locking portion is divided in two individually movable parts, wherein each movable part is configured to be actuated by a respective latch release actuator.

6. The tool belt according to claim 1, wherein the latch release mechanism is resilient and integrally formed of one single piece of material together with the latch locking portion.

7. The tool belt according to claim 1, wherein each of the two latch release actuators and/or the latch locking portion comprise(s) a release ramp, wherein the latch plate is configured to be disconnected from the female interface when the two latch release actuators are pressed simultaneously towards each other, the release ramps thereby pressing the latch locking portion in the latch release direction transverse the axis of insertion of the latch plate into the female interface.

8. The tool belt according to claim 1, wherein the male part is fixedly connected to the first end of the belt strap.

9. The tool belt according to claim 1, wherein the female part comprises a housing enclosing the locking mechanism and the length adjustment mechanism, and a cover, covering both the locking mechanism and the length adjustment mechanism.

10. A tool belt comprising a belt strap and a belt buckle, wherein the belt buckle comprises a male and a female part, the male part comprising a latch plate and the female part comprising a female interface for receiving the latch plate, wherein the male part is attached to a first end of the belt strap and the female part is attached to a second end of the belt strap, wherein the female part comprises a locking mechanism adapted for connection and disconnection of the latch plate to or from the female interface, and a length adjustment mechanism adapted for adjustment of the length of the belt strap;

wherein the second end of belt strap forms a loop around a rod in the female part, the rod being disposed at the opposite end in relation to the female interface and arranged perpendicular to an axis of insertion of the latch plate into the female interface; and wherein a belt release actuator is arranged for step-less adjustment of the second end of the belt strap.

11. The tool belt according to claim 10, wherein the belt release actuator is movable between two positions: a belt locking position, where the belt release actuator presses the second end of the belt strap against the rod, and a belt release position, where the second end of the belt strap runs freely around the rod.

12. The tool belt according to claim 11, wherein the belt release actuator is resiliently biased towards the belt locking position.

13. The tool belt according to claim 10, wherein the belt release actuator is configured to be pressed against bias in a belt release direction transversal to a direction in which latch release actuators are configured to be pressed for disconnection of the latch plate from the female interface.

14. The tool belt according to claim 10, wherein the belt release actuator is provided with tooth shaped protrusions, configured to engage with the second end of the belt strap when in the belt locking position.

15. The tool belt according to claim 10, wherein the belt release actuator is pivotal between said two positions about an axis substantially parallel to the rod, wherein the belt release actuator is configured to, when in the belt locking position, squeeze the belt strap against the rod in a self-locking manner when the first end of the belt strap is pulled in a direction away from the female part.

* * * * *